US009353531B2

(12) United States Patent
Lautzenhiser et al.

(10) Patent No.: US 9,353,531 B2
(45) Date of Patent: May 31, 2016

(54) MODULAR FLOOR COVERING SEAMING APPARATUS AND METHOD

(71) Applicants: Lloyd L. Lautzenhiser, Verdi, NV (US); Shane S. LeBlanc, Bay St. Louis, MS (US); Eloisa Mundo, Parry Sound (CA); Melinda LeBlanc, Bay St. Louis, MS (US)

(72) Inventors: Lloyd L. Lautzenhiser, Verdi, NV (US); Shane S. LeBlanc, Bay St. Louis, MS (US); Eloisa Mundo, Parry Sound (CA); Melinda LeBlanc, Bay St. Louis, MS (US)

(73) Assignee: Armorlock Industries, LLC, Bay St. Louis, MS (US)

( * ) Notice: Subject to any disclaimer, the term of this patent is extended or adjusted under 35 U.S.C. 154(b) by 0 days.

(21) Appl. No.: 14/618,752

(22) Filed: Feb. 10, 2015

(65) Prior Publication Data

US 2016/0123019 A1 May 5, 2016

Related U.S. Application Data

(60) Provisional application No. 62/072,729, filed on Oct. 30, 2014.

(51) Int. Cl.
*A47G 27/04* (2006.01)
*E04F 15/02* (2006.01)

(52) U.S. Cl.
CPC . *E04F 15/02044* (2013.01); *E04F 2015/02116* (2013.01)

(58) Field of Classification Search
CPC ..... Y10T 16/10; Y10T 16/14; Y10T 16/104; Y10T 16/109; Y10T 16/131; Y10T 428/24008; Y10T 428/24017; B60N 3/042; B60N 3/046; A47G 27/04; A47G 27/0406; A47G 27/0418; A47G 27/0431; A47G 27/045; A47G 27/0462; A47G 27/0437; A47G 27/0475; A47G 27/0293; A47G 27/025; E04F 13/088; E04F 13/0882; E04F 13/0885; E04F 13/0887; E04F 15/02044; E04F 15/02116; E04F 15/0215
See application file for complete search history.

(56) References Cited

U.S. PATENT DOCUMENTS 2,664,589 A * 1/1954 Szpilberg ..... A47G 27/0462 16/16
2,750,621 A * 6/1956 White ..... A47G 27/06 16/10

(Continued)

FOREIGN PATENT DOCUMENTS

DK 0796582 A2 * 9/1997 ..... A47G 27/0418
EP 0937431 A1 * 8/1999 ..... A47G 27/0462

(Continued)

*Primary Examiner* — Chuck Mah
(74) *Attorney, Agent, or Firm* — Duncan Galloway Egan Greenwald, PLLC; Kevin T. Duncan

(57) ABSTRACT

A clip connector seaming apparatus having upstanding projections arranged in sections to point inwardly on the lateral and longitudinal axes adapted to join a plurality of modular floor covering units comprising a modular floor covering is provided. The clip connector may comprise a releasable silicone backing and a pressure sensitive tape to affix or "tack" the clip connector to a supporting surface. The clip connector does not require any spray adhesives or additional glue to affix floor covering units to a support surface and is resistant to wear, moisture, excessive force. The clip connector may also be reusable to provide for replacing individual floor covering units.

22 Claims, 7 Drawing Sheets

(56) References Cited

U.S. PATENT DOCUMENTS 3,047,903 A * 8/1962 Reinhard ..... A47G 27/0462 16/16
3,551,939 A * 1/1971 Rager ..... A47G 27/06 16/10
3,693,212 A * 9/1972 Handy ..... A47G 27/0462 16/16
3,950,816 A * 4/1976 Hill ..... A47G 27/0462 16/16
4,340,633 A * 7/1982 Robbins, Jr. ..... A47G 27/0412 156/297
4,970,754 A * 11/1990 Anderson ..... A47G 27/0462 16/16
5,465,659 A * 11/1995 Minen ..... B65B 27/10 100/26
5,761,765 A * 6/1998 Fuzzell ..... A47G 27/0418 16/16
5,800,664 A * 9/1998 Covert ..... A47G 27/0462 156/304.4
5,815,995 A * 10/1998 Adam ..... A47L 23/24 15/215
5,822,828 A * 10/1998 Berard ..... A47G 27/045 16/16
6,216,315 B1 * 4/2001 Fuzzell ..... A47G 27/0418 16/16
6,708,367 B2 * 3/2004 Billson ..... A47G 27/0462 16/16
8,763,203 B2 * 7/2014 Greathouse ..... A47G 27/0462 16/16
2007/0204556 A1 * 9/2007 Pacione ..... A47G 27/0293 52/745.21
2011/0005031 A1 * 1/2011 Bailey, Jr. ..... A47G 27/0418 16/4
2012/0073081 A1 * 3/2012 Crenshaw, Sr. .... A47G 27/0418 16/17.1
2014/0113110 A1 * 4/2014 Johnson ..... B60N 3/048 428/172
2014/0150206 A1 * 6/2014 Currin ..... A47G 27/045 16/16

FOREIGN PATENT DOCUMENTS

GB 269278 A * 4/1927 ..... A47G 27/0418
GB 1350767 A * 4/1974 ..... A47G 27/0462

* cited by examiner

MODULAR FLOOR COVERING SEAMING APPARATUS AND METHOD

CROSS REFERENCE TO RELATED APPLICATION

The present invention claims benefit of priority to U.S. Prov. Pat. App. No. 62/072,729, entitled MODULAR FLOOR COVERING SEAMING APPARATUS AND METHOD, filed on Oct. 30, 2014, (Lautzenhiser et al.) and is incorporated by reference herein in its entirety.

BACKGROUND OF THE INVENTION

1. Field of the Invention

The present invention pertains to the art of carpets and, more particularly, to an apparatus for use in joining adjacent sections of modular floor covering units. More particularly, the present invention relates to an apparatus and method for using said apparatus as a connector for joining a plurality of modular floor covering units to one another and to a supporting surface.

2. Discussion of the Prior Art

In the field of modular floor covering unit installation, existing methods of installing such floor coverings typically involve a very labor and material intensive process. The process involves individually gluing down floor covering units using an adhesive. The adhesive is heavy, difficult to apply, costly, difficult to remove, and prone to failure. Using the prior art method, adhesive must be applied to the entire supporting surface or the entire underside of a floor covering unit. This process is costly in both labor and money and creates additional costs if floor covering units are to be replaced or removed.

Another method known in the art for installing modular floor covering units involves using adhesive connectors to connect modular floor covering units with adjacent units. Such "connector systems" of the prior art allow the modular floor covering to "float" on top of the supporting surface. These prior art systems use an adhesive to hold the edges of the adjacent flooring units together. One such system and method is the SYSTEM FOR CARPET TILE INSTALLATION, U.S. Pat. No. 8,434,282, issued May 7, 2013 (Scott et al.), which is incorporated herein by reference in its entirety. The method described in Scott et al. utilizes a one sided pressure sensitive adhesive tab that is approximately 72 mm square that has a releasable protective layer to join four sections of modular flooring units together. There a several problems with using this method to install a modular floor covering.

The modular flooring units are typically heavy in nature and the bond between the tile connector and modular flooring unit is relatively weak compared to traditional adhesives. In the Scott et al. tile connector, the connector is formed from an inert plastic that is coated with an adhesive. Although the connector is water resistant, it is not completely waterproof. This may cause the connector to fail under some conditions. Floor covering units are constantly under attack from moisture. The Scott et al. prior art claims the connectors are water resistant because the connectors only have adhesive on one side, the upwards facing side, making the connector less susceptible to moisture from the subfloor. However, this ignores adhesive failure from moisture sources above the connector. For example, a business such as a hotel may steam clean the floor covering unit connected by a Scott et al. type adhesive connector. Further the floor frequently may have liquids spilled on it and may experience wet winter conditions. This "wetting" occurs from above and moisture leeches down onto the face of the prior art connector, making it highly susceptible to moisture and potential connector failure.

The Scott et al. type prior art tile connectors have a high rate of failure in areas of heavy traffic and along modular flooring unit seams. Heavier traffic from office equipment, foot traffic, chairs etc. puts a strain on these connectors. The strain from heavier traffic may cause the connectors to fail in one or more ways.

The first type of failure for the Scott et al. type adhesive connectors is that the glue will stretch or fail under a heavy force such a chair rolling or other heavy object being moved across the floor covering. To address this problem, modular floor covering installers may use a spray adhesive in a can to supplement this type of adhesive connector system to give the seams of the modular floor covering extra strength. However, doing so removes most of the advantages of this type of connector system and introduces volatile organic chemicals ("VOCs") into the installation area. VOCs present in the installation area require at a minimum additional ventilation and may also necessitate installing the modular floor covering after work hours when an area is subject to much lower traffic.

The second type of failure occurs if there is an excessive force in one direction. If such a force is imparted on the connector, the adhesive connector will fail altogether and "bunch up" underneath the modular flooring unit causing a "profiling" underneath that can be seen above the surface of the modular flooring unit.

Furthermore, the Scott et al. type prior art connector may only be used with modular floor covering units having a proprietary backing (e.g., a composite glass backing) that is used in the manufacturing process.

There also exist other carpet seaming methods for joining together two segments of floor covering material along long, straight seams. Such methods include CARPET SEAMING APPARATUS AND METHOD OF UTILIZING THE SAME, U.S. Pat. No. 5,800,664, issued Sep. 1, 1998 (Covert), and SEAMING APPARATUS AND METHOD, U.S. patent application Ser. No. 14/309,632, filed Jun. 19, 2014, (LeBlanc et al.), both of which are incorporated herein by reference in their entirety.

What is needed is a modular floor covering unit connector for joining adjacent modular floor covering units that is resistant to pressure, lateral force, moisture, high traffic, heavy loads, and excessive wear that may be used on a variety of support surfaces to join multiple types of modular floor covering units.

SUMMARY OF THE INVENTION

The carpet tile seaming apparatus, or clip connector, of the present invention provides a durable seam for joining modular tile floor covering units. The seam secured by the clip connector is both more secure and more durable than those in the prior art. The pressure sensitive tape used in the clip connector is waterproof to provide wear resistance in high traffic, frequently cleaned indoor applications.

The clip connector of the present invention may comprise an electro-galvanized steel coil metal plate with an approximate thickness of 0.40 mm. The metal used in the production of the clip connector may comprise 100% recycled materials. The back side of the clip connector may comprise a pressure sensitive fiber tape of approximately 0.1 mm in thickness and a releasable silicone tape protective layer which also serves as a moisture barrier. The clip connector may comprise a set of upwardly angled metal projections that are laterally and vertically opposed to one another. Each clip connector according to the present invention may comprise upstanding projections that penetrate the backing of a floor covering unit on two axes (laterally and longitudinally).

Score lines starting at the corners of the clip connector and projecting inwards towards the center may be stamped into the electro-galvanized plate to help an installer line up the four corners of the modular floor covering units to be joined by the clip connector. The score lines may be used as guides for an installer so that approximately ¼ of the clip connector is utilized per modular flooring unit. The clip connector may have an approximate length and width of 76 mm. The clip connector also comprises a flat center having an area that is approximately 36 mm square. During installation, the clip connector would typically be positioned such that ¼ of the surface of the clip connector is in contact with each of the floor covering units being joined by the clip connector.

Support surfaces or subfloors, such as concrete, on which the clip connector may be installed may "sweat" creating moisture underneath the clip connector. Any adhesive system including adhesive connectors will be exposed to this moisture and as with any adhesive, may eventually break down potentially causing failure of the adhesive connector. This moisture can cause failure of complete glue down modular floor covering installations and of adhesive connector floor covering installations. When the clip connector of present invention is used to secure modular floor covering units, the releasable silicone layer acts as a vapor barrier to the "sweated" moisture.

With the prior art methods, installing modular floor covering units in a large area in straight rows can be difficult. The present invention provides for a "tacking" system during the installation process that enables an installer to "tack" the clip connector to the subflooring at intervals to ensure that a row will stay true on a long run of modular flooring. This "tacking" during the installation process substantially reduces human error and alleviates the problem of having to reinstall a substantial amount of the installed modular floor covering units. The "tack" system used by an installer is primarily used to assist in the installation process. If the "tack" system fails in the future due to moisture from the subfloor, the clip connector will still not fail or move as the clip connector's upstanding projections will keep the modular floor covering unit in place. The electroplating of the clip connector makes the clip connector impervious to moisture as well.

Unlike the adhesive connectors of the prior art that may only be used with proprietary modular floor covering unit backings, the clip connector of the present invention may be used with any backing of any floor covering unit. The clip connector of the present invention may also be used if an old floor covering unit is not replaced or removed but is instead covered over if such an application is approved by the floor covering unit manufacturer.

In one embodiment, the present invention provides an apparatus for joining modular floor coverings, the apparatus comprising: a plate having an upper surface and a lower surface, said lower surface being substantially smooth and said upper surface having a perimeter edge and being divided into a flat central zone and a set of edge zones, said set of edge zones extending transversely along said perimeter edge between said perimeter edge and said flat central zone; a plurality of sharp projections extending upwardly at spaced locations from said set of edge zones, said projections having a top and body portion, the top being tapered to promote piercing engagement with a floor covering backing and the body extending upwards from the upper surface at an angle of less than 90 degrees, and said projections extending inwardly towards said central zone; and an adhesive layer positioned on said lower surface, said adhesive layer covered by a releasable backing; wherein said plate is adapted to be positioned on a supporting surface to join a set of modular floor covering units having a backing positioned on said upper surface of said plate, and wherein said plurality of sharp projections are adapted to engage said backing to secure said modular floor covering units.

The apparatus according to the embodiment may further comprise wherein said upper surface further comprises a set of score lines. The plate may be rectangular. The apparatus may further be adapted to join a plurality of modular floor covering sections wherein each of said plurality of said floor covering sections is engaged by an equal percentage of said sharp projections. The plate may comprise an electro-galvanized plate. The releasable backing may be a releasable silicon backing. The releasable backing may be adapted to block moisture. The sharp projections may be 5 mm in length from an attached proximal end to said top. The edge zones may comprise two laterally oriented edge zones and two longitudinally oriented edge zones. The sharp projections in said edge zones may be adapted to engage said floor covering units on a lateral axis and on a longitudinal axis. The sharp projections in said edge zones may be adapted to engage said floor covering units from a plurality of directions and wherein said sharp projections are adapted to prevent said floor covering units from moving along or away from a seam created by adjacent floor covering units.

In another embodiment, the present invention provides an apparatus for joining modular floor coverings, the apparatus comprising: a plate having an upper surface and a lower surface, said lower surface being substantially smooth and said upper surface having a perimeter edge and being divided into a flat central zone and a set of edge zones, said set of edge zones extending transversely along said perimeter edge between said perimeter edge and said flat central zone; a plurality of sharp projections extending upwardly at spaced locations from said set of edge zones, said projections having a top and body portion, the top being tapered to promote piercing engagement with a floor covering backing and the body extending upwards from the upper surface at an angle of less than 90 degrees, and said projections extending inwardly towards said central zone; and wherein said plate is adapted to be positioned on a supporting surface to join a set of modular floor covering units having a backing positioned on said upper surface of said plate, and wherein said plurality of sharp projections are adapted to engage said backing to secure said modular floor covering units.

The embodiment may further comprise wherein said upper surface further comprises a set of score lines. The plate may be rectangular. The apparatus may further be adapted to join a plurality of modular floor covering sections wherein each of said plurality of said floor covering sections is engaged by an equal percentage of said sharp projections. The plate may comprise an electro-galvanized plate. The apparatus may further comprise an adhesive layer positioned on said lower surface, said adhesive layer covered by a releasable backing. The releasable backing may be a releasable silicon backing adapted to block moisture. The sharp projections may be 5 mm in length from an attached proximal end to said top. The edge zones may comprise two laterally oriented edge zones and two longitudinally oriented edge zones. The sharp projections in said edge zones may be adapted to engage said floor covering units on a lateral axis and on a longitudinal axis. The sharp projections in said edge zones may be adapted to engage said floor covering units from a plurality of directions and wherein said sharp projections are adapted to prevent said floor covering units from moving along or away from a seam created by adjacent floor covering units.

In yet another embodiment, the present invention provides a method for joining modular floor coverings, the method comprising: placing a connector plate on a supporting surface, said connector plate comprising: a plate having an upper surface and a lower surface, said lower surface being substantially smooth and said upper surface having a perimeter edge and being divided into a flat central zone and a set of edge zones, said set of edge zones extending transversely along said perimeter edge between said perimeter edge and said flat central zone; a plurality of sharp projections extending upwardly at spaced locations from said set of edge zones, said projections having a top and body portion, the top being tapered to promote piercing engagement with a floor covering backing and the body extending upwards from the upper surface at an angle of less than 90 degrees, and said projections extending inwardly towards said central zone; and positioning a first floor covering unit having a backing on the connector plate such that the backing of the first floor covering unit covers a first portion of the upper surface of the connector plate; and securing the first floor covering unit on the connector plate by applying a pressure on the first floor covering unit such that the backing is penetrated by and engaged with the plurality of sharp upstanding projections of the connector plate.

The embodiment may further comprise wherein said upper surface further comprises a set of score lines and wherein the first floor covering unit is aligned on said connector plate at least in part by said score lines. The plate may be rectangular. The method may further comprise positioning a second floor covering unit having a backing on the connector plate such that the backing of the second floor covering unit covers a second portion of the upper surface of the connector plate; and securing the second floor covering unit on the connector plate by applying a pressure on the second floor covering unit such that the backing is penetrated by and engaged with the plurality of sharp upstanding projections of the connector plate. The plate may comprise an electro-galvanized plate. The connector plate may further comprise an adhesive layer positioned on said lower surface, said adhesive layer covered by a releasable backing. The releasable backing may be a releasable silicon backing adapted to block moisture, and the method may further comprise removing the releasable backing prior to placing the connector plate on the supporting surface causing the adhesive layer to adhere to the supporting surface. The sharp projections may be 5 mm in length from an attached proximal end to said top. The edge zones may comprise two laterally oriented edge zones and two longitudinally oriented edge zones. The sharp projections in said edge zones may be adapted to engage said floor covering units on a lateral axis and on a longitudinal axis. The sharp projections in said edge zones may be adapted to engage said floor covering units from a plurality of directions and wherein said sharp projections are adapted to prevent said floor covering units from moving along or away from a seam created by adjacent floor covering units.

Additional features and advantages of the clip connector of the present invention will become more readily apparent from the following detailed description of the preferred embodiment thereof, when taken in conjunction with the drawings wherein like reference numerals refer to corresponding parts in the several views.

BRIEF DESCRIPTION OF THE DRAWINGS

In order to facilitate a full understanding of the present invention, reference is now made to the accompanying drawings, in which like elements are referenced with like numerals. These drawings should not be construed as limiting the present invention, but are intended to be exemplary and for reference.

DETAILED DESCRIPTION

The present invention will now be described in more detail with reference to exemplary embodiments as shown in the accompanying drawings. While the present invention is described herein with reference to the exemplary embodiments, it should be understood that the present invention is not limited to such exemplary embodiments. Those possessing ordinary skill in the art and having access to the teachings herein will recognize additional implementations, modifications, and embodiments, as well as other applications for use of the invention, which are fully contemplated herein as within the scope of the present invention as disclosed and claimed herein, and with respect to which the present invention could be of significant utility.

Figure 1:
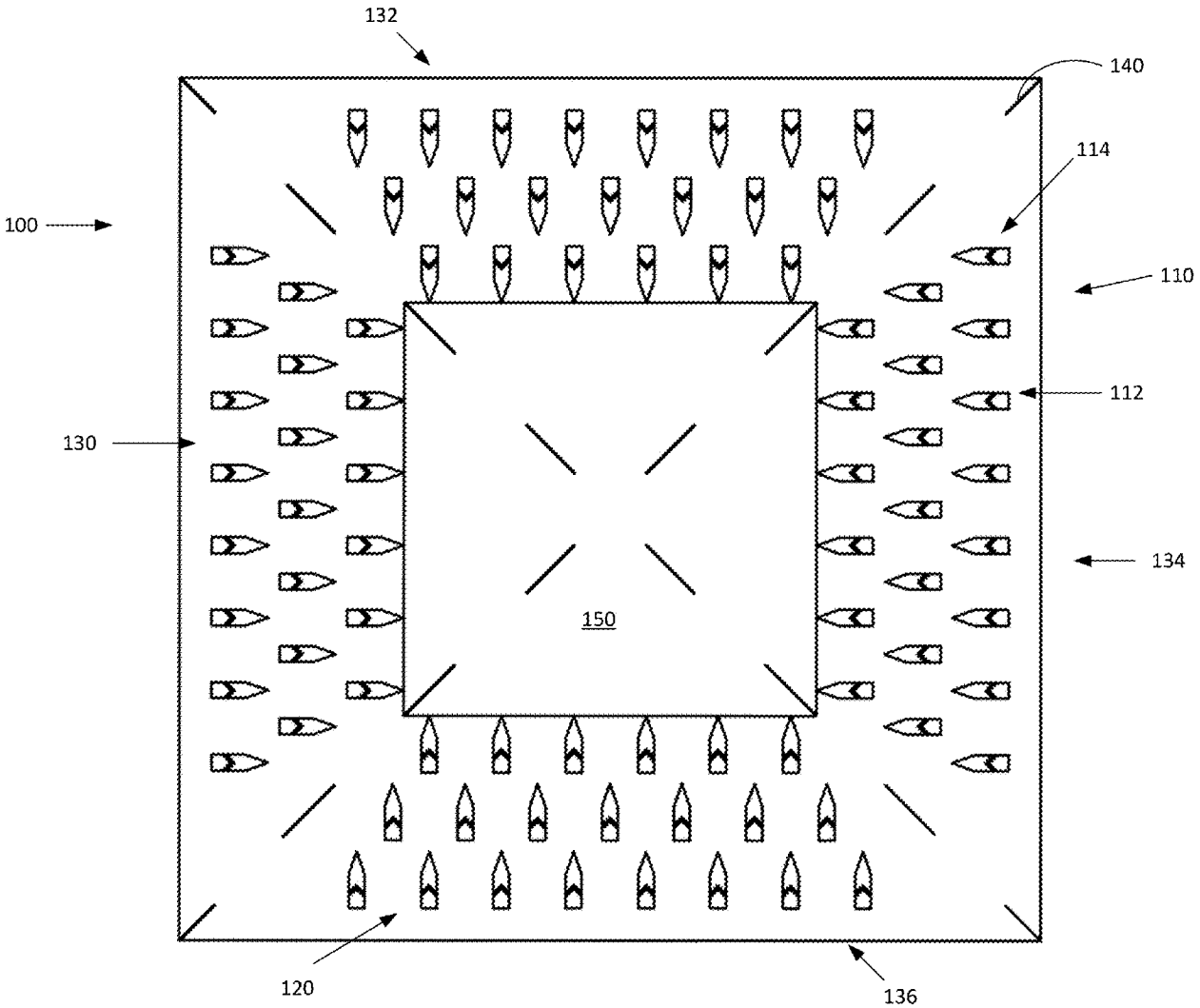
FIG. 1 is a plan view of an embodiment of a clip connector of the present invention.

With reference to FIG. 1 a plan view of an embodiment of a clip connector 100 of the present invention is provided. The clip connector 100 may comprise an electro-galvanized steel coil metal plate with an approximate thickness of 0.40 mm. The clip connector 100 may be 76 mm long and wide, and the central area 150 of the clip connector 100 may be 36 mm long and wide. The edge area of the clip connector 100 is divided into four sections 130, 132, 134, and 136, each section having a set of upstanding projections 110, by score lines 140. The score lines 140 also assist an installer in placing each modular floor covering unit to be joined by the clip connector 100 over approximately ¼ of the surface of the clip connector 100. The clip connector 100 may be formed by a stamping process wherein the clip connector 100 is formed form a single piece of metal or other suitable material. The upstanding projections 110 and 120 are formed simultaneously with the plate of the clip connector 100 such that they are integrally attached when the clip connector 100 is formed by stamping.

The upstanding projections 110 in section 134 are arranged into rows 112 and columns 114. Each upstanding projection in the set of upstanding projections 110 may be 1.4 mm wide and 5 mm long from the proximal to the distal end. The length of each upstanding projection 110 is determined to be long enough to penetrate and secure a modular floor covering unit but not so long as to pierce entirely through the floor covering unit causing a hazard. The projections 110 extend upwards at an approximate 70 degree angle and the distance from the upper surface of the clip connector 110 to the distal end of any individual projection may be 4.7 mm. The distance from the proximal end of one upstanding projection to the distal end of another projection in the same row may be 7 mm. The distance from the distal end of one projection to the distal end of a projection in an adjacent, staggered row may be 6 mm. The distance between each projection in a column may be 5 mm. The distance from the last projection in the column closest to the top or bottom edge of the clip connector 100 may be 15 mm. The columns 114 of projections 110 are staggered, each column 114 closer to the center of the clip connector 110 having one fewer upstanding projection that the previous column. The upstanding projections 110 point inward on the lateral axis of the clip connector 110, while the upstanding projections 120 point inward on the longitudinal axis of the clip connector 100. The back side of the clip connector 100 may comprise a layer of pressure sensitive fiber tape of approximately 0.1 mm in thickness and a releasable silicone tape protective layer which may also serve as a moisture barrier. Additionally, the central area 150 may comprise a layer of adhesive such as butyl rubber tape or pressure sensitive fiber tape that may be covered by a releasable layer. This additional adhesive layer in the center area 150 may be used to further secure some types of modular flooring units.

Prior to the installation of any clip connector 100 or floor covering unit, the subfloor or supporting surface may need to be prepared. Floors must be clean, dry and free of dirt, dust and oil. The installation site must be acclimated with HVAC in operation. The floor and room temperature, as well as flooring materials and adhesive, must be maintained at 65°-95° F., and the humidity below 65% for 48 hours prior to, during, and after the testing and installation. Substrates that have been chemically cleaned or when adhesive has been chemically removed, extra steps may need to be taken to ensure a proper installation. Where the subfloor is concrete, the concrete must be fully cured, free of moisture, sound, clean and meet industry standards as defined in American Concrete Institute Committee Report 302.1.04 R. New concrete requires a curing period of approximately 90 days. For old concrete, the concrete must be checked for moisture. Dry, dusty, porous floors must be primed or encapsulated. For a wood floor, the floor must be smooth and level. If the floor is uneven, an approved underlayment will be required. Old finishes must be tested for compatibility with adhesives or removed and porous wood primed. For terrazzo or marble floors, all grout lines must be leveled with an appropriate cement-based patch reinforced with polymers. For other hard surfaces, any floor tiles must be well secured to the floor or removed. Broken, damaged, or loose tiles must be replaced.

For the installation of modular floor covering units using the clip connector 100, the first floor covering unit is positioned adjacent to the adjoining floor covering unit so that ¼ of the clip connector 100 adheres to each of the adjacent floor covering units. In this manner, the clip connector spans the gap between the edge of one floor covering unit and the edge of the adjacent floor covering unit. A floor covering unit installed using the clip connector 100 may be assembled on an underlying flooring surface, a subfloor, without the need to attach the floor covering unit to the floor surface. If desired in a large area, the releasable silicone tape on the bottom of the clip connector 100 may be removed and the clip connector 100 may be adhered directly to the underlying flooring surface. This method of installation may be desired when a pattern is printed on the top of the floor covering unit. After a long run of modular flooring units are placed, an installer, without adhering the clip connector 100 to the flooring surface, may be slightly off of the pattern. Adhering the clip connector 100 to the floorings surface enables the installer to keep the rows of adjacent floor covering units in a straight line in a large area. If the releasable silicone backing is not removed, it will act as a moisture barrier against the underlying flooring surface (e.g., concrete).

The upstanding projections 110 and 120 of the clip connector 100 penetrate the backing of a floor covering unit on two axes. The floor covering unit to be installed using the clip connector 100 is pressed on firmly with a thumb or a blunt tool to "start" the penetration process. A roller such as a three inch tractor roller may be used along the seam of the floor covering units to seat the floor covering units on to the clip connector 100. This seating causes the upstanding projections 110 and 120 to be depressed downwards, from an initial angle of approximately 70 degrees to a final angle of approximately 15 degrees. Two or three taps on the floor covering unit with a rubber mallet or similar device pushes the floor covering unit flush with the plate of the clip connector 100 on two axes locking the floor covering unit in place. When four units are placed together, any force in any direction enable the floor covering units to stay in place. In this way the risk of failure is greatly diminished. In the installation process, an installer can easily pull the clip connector 100 out of the backing of the floor covering unit. If the majority of the upstanding projections 110 and 120 have not bent beyond a 45 degree angle from their original orientation, the clip connector 100 may be used again. If removed shortly after installation, the clip connector 100 may be reused to secure a replacement floor covering unit. However, if a replacement panel is needed months or years after installation, a new clip connector 100 would likely be needed as most if not all of the upstanding projections 110 and 120 would likely have bent beyond a 45 degree angle. The seventy degree angle of the upstanding projections 110 and 120 ensure that a person will not "feel" the projection through the floor covering unit. A floor covering installed using clip connectors 100 will dissipate forces throughout the entire floor covering instead of applying tension on a single clip connector 100 or seam. Using a non-adhesive method entirely eliminates adhesive failure and does not produce any fumes or harmful VOCs that would be present in complete glue down systems. In the prior art adhesive connector systems, during installation installers may still be required to use a spray adhesive for extra adhesion which may introduce fumes and VOC's into the installation environment.

The floor covering units used in the installation may be installed in several different patterns. For a "monolithic" or grid like pattern, clip connector 100 would be installed only at the corners at the points of abutment between two or more floor covering units. For an offset pattern clip connectors 100 would need to be installed at each at the corner at the points of abutment between two or more floor covering units, which would require some clip connectors 100 to be installed at the lateral or longitudinal edges of some of the floor covering units.

Figure 2:
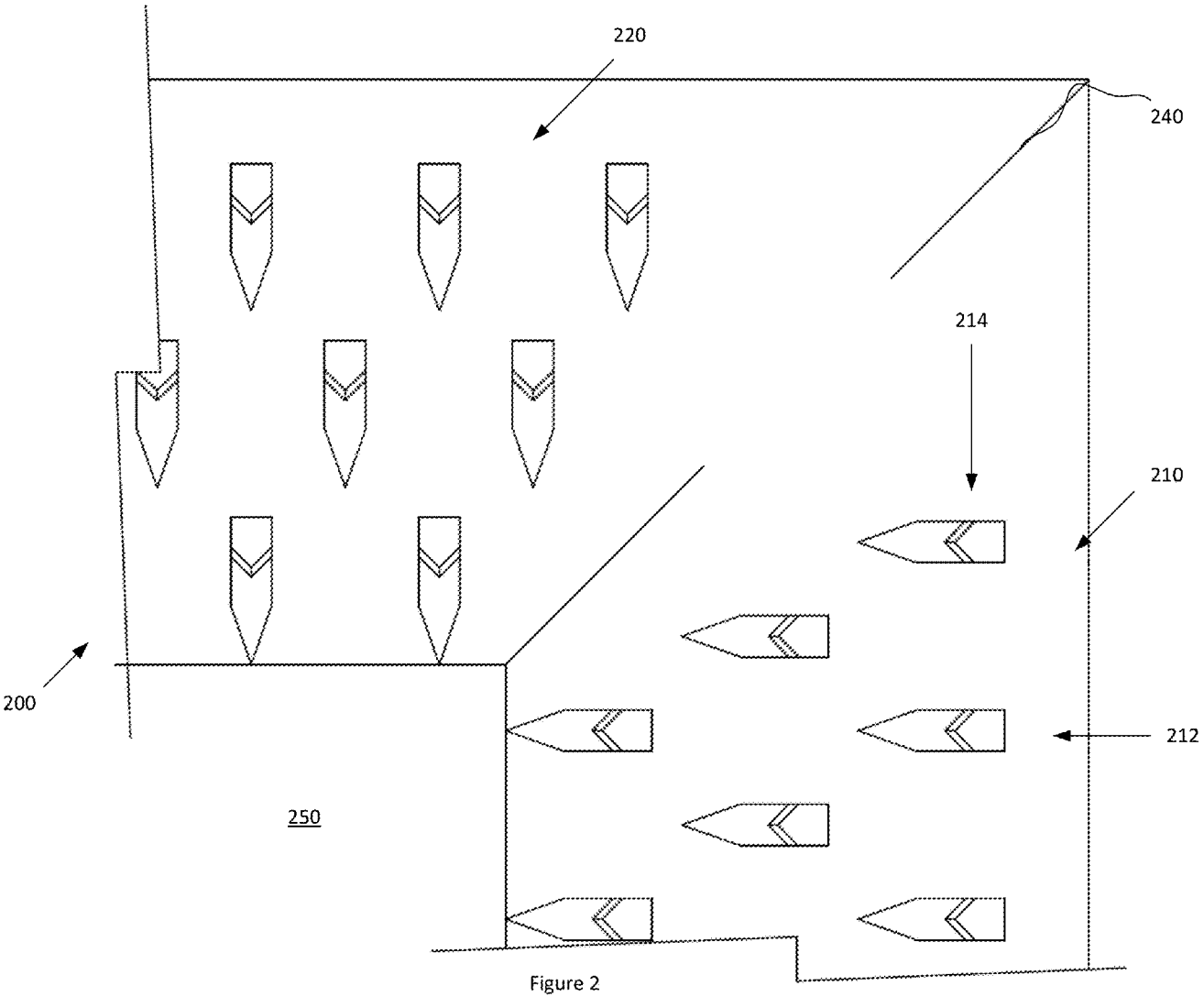
FIG. 2 is a plan view of an embodiment the upstanding projections of a clip connector of the present invention.

With reference now to FIG. 2 a detailed plan view of an embodiment the upstanding projections 210 of a clip connector 200 of the present invention is provided. The detailed view of the upstanding projections 210 shows the projections 210 arranged in rows 212 and columns 214. The upstanding projections 210 point inwards towards the center area 250 of the clip connector 200. Each set of upstanding projections 210 comprises three columns of teeth if arranged longitudinally (e.g., upstanding projections 210), or three columns of teeth if arranged laterally (e.g., upstanding projections 220). Score lines 240 assist an installer in properly aligning floor covering units over the clip connector 210.

Figure 3:
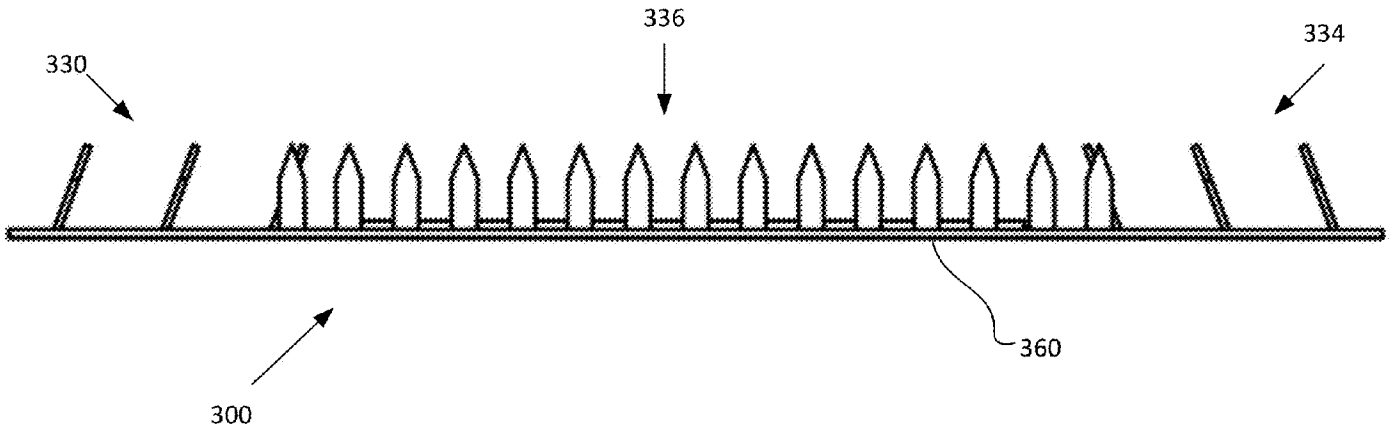
FIG. 3 is a cross-sectional view of an embodiment of a clip connector of the present invention.

With reference now to FIG. 3, a cross-sectional view of an embodiment of a clip connector 300 of the present invention is provided. The bottom surface 360 of the clip connector 300 may comprise a fiber tape adhesive layer and a releasable silicon backing layer. The backing layer may be left in place to serve as a vapor barrier or may be removed to allow an installer to "tack" the clip connector 300 in place during the installation process. "Tacking" allows an installer to line up the clip connector 300 with other clip connectors to ensure straight lines of floor covering units in larger installation areas. Two sets of upstanding protrusions 330 and 334 are oriented to point inwardly on the lateral axis of the clip connector 300, while the visible set of upstanding protrusions 336 points inwardly on the longitudinal axis.

Figure 4:
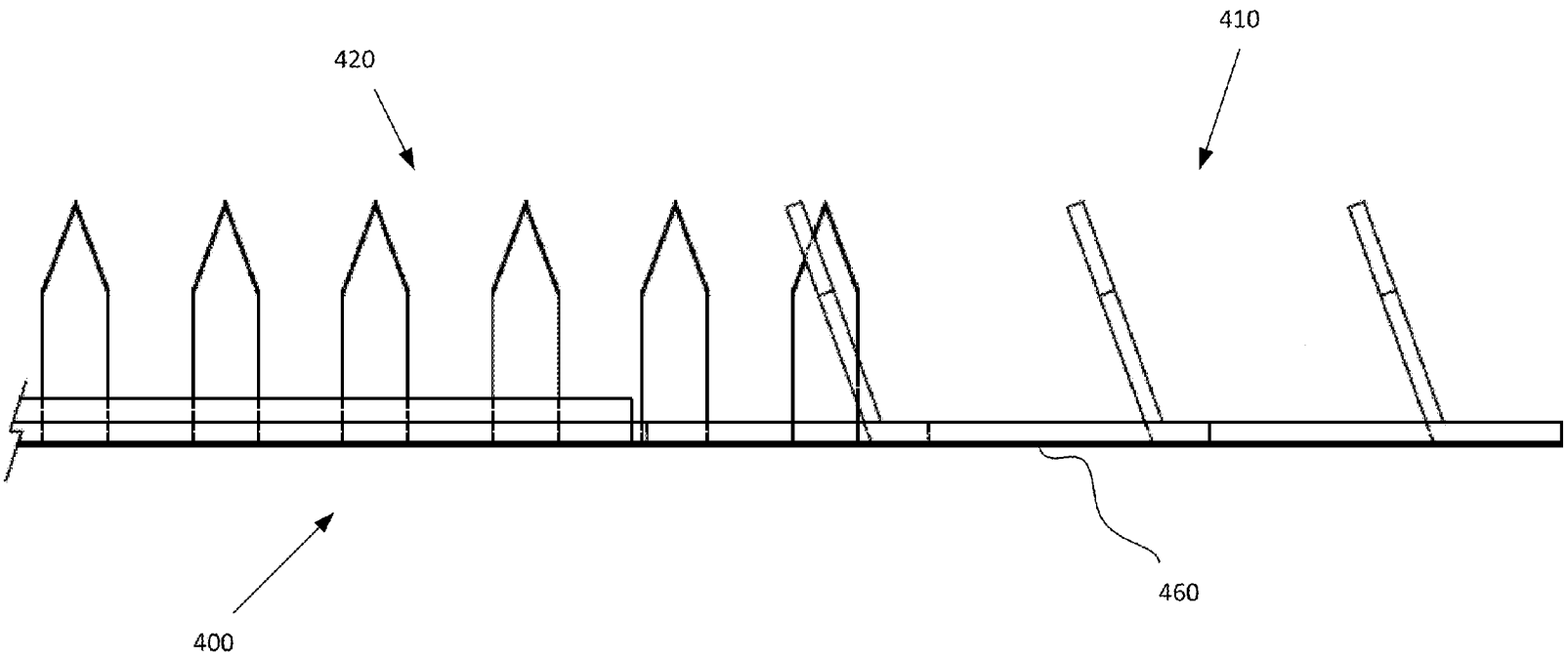
FIG. 4 is a detailed view of a cross-section of the upstanding projections of an embodiment of a clip connector of the present invention.

With reference now to FIG. 4, a detailed view of a cross-section of the upstanding projections 410 and 420 of an embodiment of a clip connector 400 of the present invention is provided. The upstanding projections 410 point inwardly towards the center of the clip connector 400 along the lateral axis of the connector. Each projection in the sets of upstanding projections 410 and 420 is raised at an approximate 70 degree angle towards the center of the clip connector 400. Each upstanding projection may be 5 mm long and each distal end is raised approximately 4.7 mm from the upper surface of the clip connector 400. The bottom surface 460 of the clip connector 400 may comprise a fiber tape adhesive layer and a releasable silicon backing layer.

Figure 5B:
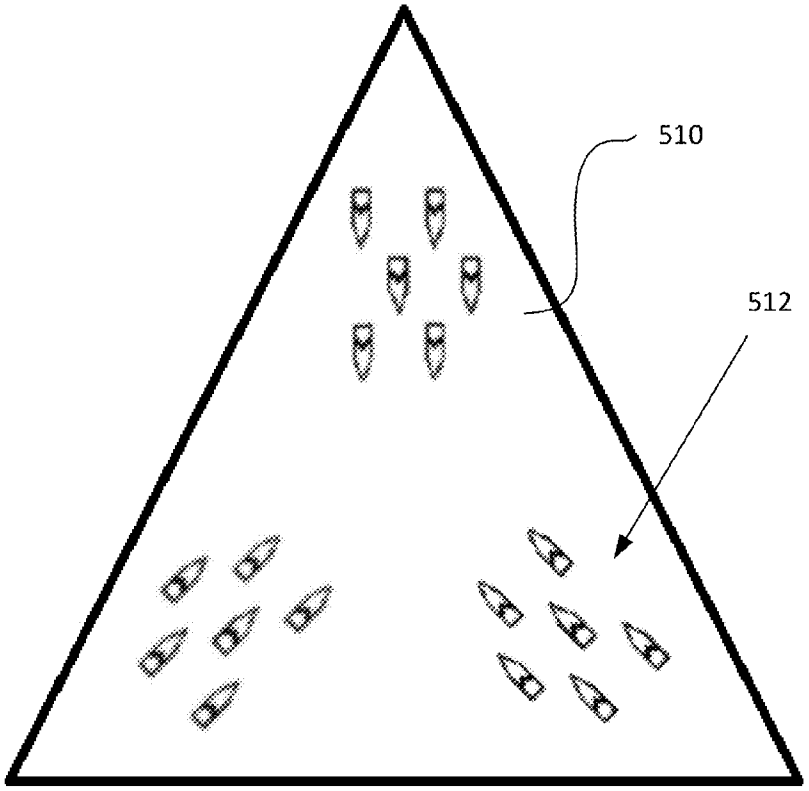
FIG. 5B is a plan view of another embodiment of a clip connector of the present invention.
Figure 5A:
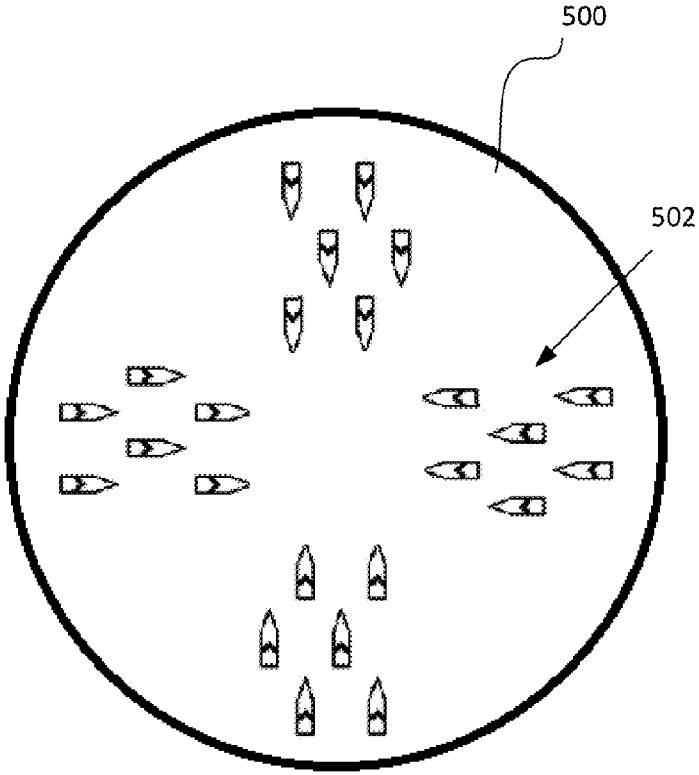
FIG. 5A is a plan view of another embodiment of a clip connector of the present invention.

With reference now to FIGS. 5A and 5B, embodiments of a circular clip connector 500 and a triangular clip connector 510 of the present invention are provided. The circular clip connector 500 may have a plurality of sets of upstanding protrusions 502 arranged zones or sections to point inwardly towards the center of the circular clip connector 500. The triangular clip connector 510 may have a plurality of sets of upstanding protrusions 512 arranged zones or sections to point inwardly towards the center of the triangular clip connector 510. The clip connector of the present invention may also be comprise any other shape to accommodate different types of floor covering units and floor covering unit installation patterns. The clip connector of the present invention may be shaped into hexagonal, octagonal, rectangular, or other geometrical configurations depending on the desired installation application.

Figure 6:
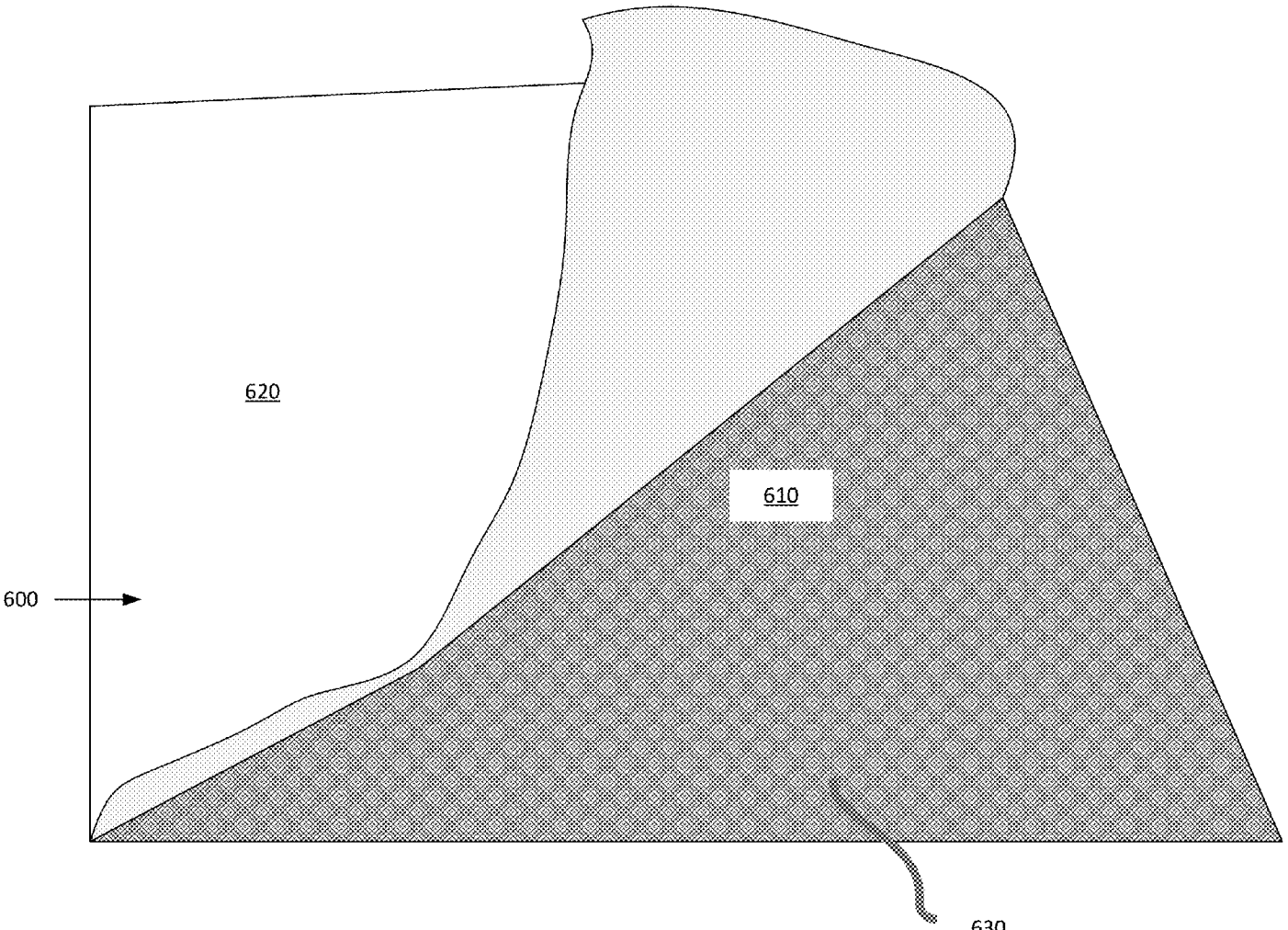
FIG. 6 is a perspective view of the releasable silicone layer and pressure sensitive fiber tape in an embodiment of a clip connector of the present invention.

With reference now to FIG. 6, a perspective view of the releasable silicone layer 620 and pressure sensitive fiber tape 610 in an embodiment of a clip connector 600 of the present invention is provided. The releasable silicone layer 620 may serve as a vapor or moisture barrier for the clip connector 600 if the clip connector is not "tacked" onto a flooring surface using the fiber tape 610. Also visible from this bottom perspective view are the openings left in the plate of the clip connector 600 after forming the upstanding projections that project upwards on the opposite side of the clip connector 600.

Figure 7:
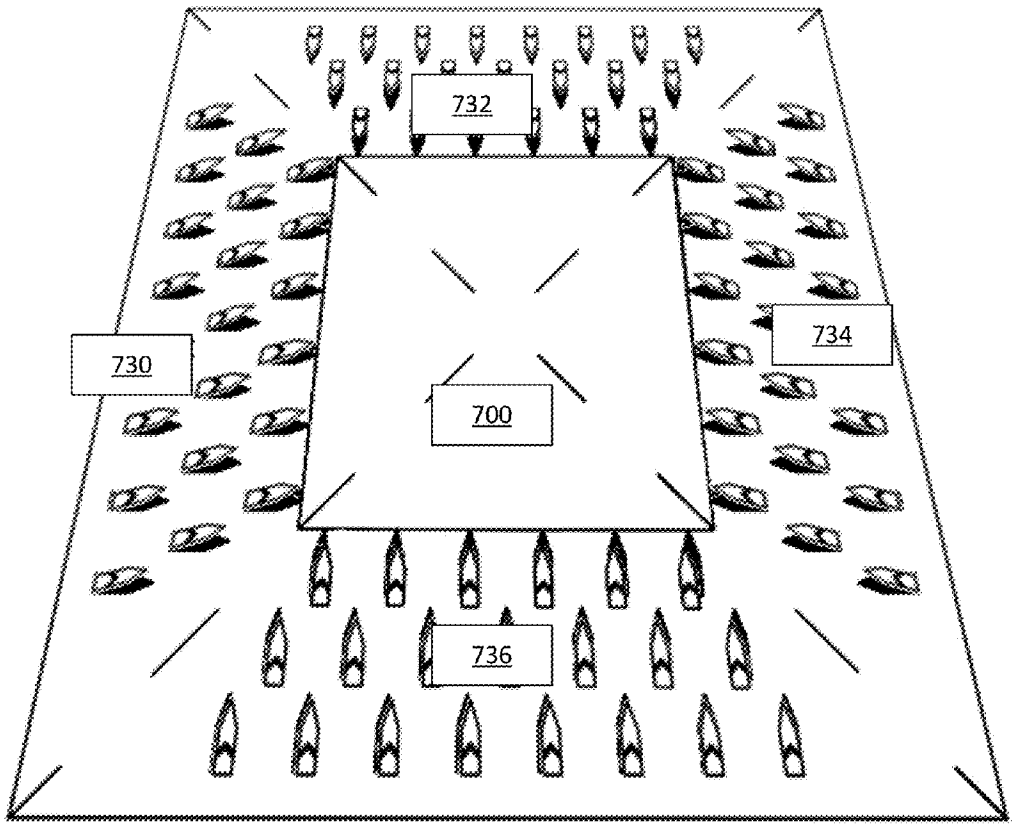
FIG. 7 is a perspective view of an embodiment of a clip connector of the present invention.

With reference now to FIG. 7, a perspective view of an embodiment of a clip connector 700 of the present invention is provided. The clip connector 700 comprises left lateral zone 730, top zone 732, right lateral zone 734, and bottom zone 736. Each of the zones 730, 732, 734, and 736 comprise a set of upstanding protrusions arraigned in three rows or columns pointing inwards to the center of the clip connector 700. The nail shape of the upstanding protrusions and the 70 degree angle of the protrusions can be seen clearly in this perspective.

While the invention has been described by reference to certain preferred embodiments, it should be understood that numerous changes could be made within the spirit and scope of the inventive concept described. Also, the present invention is not to be limited in scope by the specific embodiments described herein. It is fully contemplated that other various embodiments of and modifications to the present invention, in addition to those described herein, will become apparent to those of ordinary skill in the art from the foregoing description and accompanying drawings. Thus, such other embodiments and modifications are intended to fall within the scope of the following appended claims. Further, although the present invention has been described herein in the context of particular embodiments and implementations and applications and in particular environments, those of ordinary skill in the art will appreciate that its usefulness is not limited thereto and that the present invention can be beneficially applied in any number of ways and environments for any number of purposes. Accordingly, the claims set forth below should be construed in view of the full breadth and spirit of the present invention as disclosed herein.

What is claimed is:

1. An apparatus for joining modular floor coverings, the apparatus comprising:

a plate having an upper surface and a lower surface, said lower surface being substantially smooth and said upper surface having a perimeter edge and being divided into a flat central zone and a set of edge zones, said set of edge zones extending transversely along said perimeter edge between said perimeter edge and said flat central zone;

a plurality of sharp projections extending upwardly at spaced locations from said set of edge zones, said projections having a top and body portion, the top being tapered to promote piercing engagement with a floor covering backing and the body extending upwards from the upper surface at an angle of less than 90 degrees, and said projections extending inwardly towards said central zone; and wherein said plate is adapted to be positioned on a supporting surface to join a set of modular floor covering units having a backing positioned on said upper surface of said plate, and wherein said plurality of sharp projections are adapted to engage said backing to secure said modular floor covering units.

2. The apparatus of claim 1 wherein said upper surface further comprises a set of score lines.

3. The apparatus of claim 1 wherein said plate is rectangular.

4. The apparatus of claim 1 wherein the apparatus is further adapted to join a plurality of modular floor covering sections wherein each of said plurality of said floor covering sections is engaged by an equal percentage of said sharp projections.

5. The apparatus of claim 1 wherein said plate comprises an electro-galvanized plate.

6. The apparatus of claim 1 further comprising an adhesive layer positioned on said lower surface, said adhesive layer covered by a releasable backing.

7. The apparatus of claim 6 wherein said releasable backing is a releasable silicon backing adapted to block moisture.

8. The apparatus of claim 1 wherein said sharp projections are 5 mm in length from an attached proximal end to said top.

9. The apparatus of claim 1 wherein said edge zones comprise two laterally oriented edge zones and two longitudinally oriented edge zones.

10. The apparatus of claim 1 wherein said sharp projections in said edge zones are adapted to engage said floor covering units on a lateral axis and on a longitudinal axis.

11. The apparatus of claim 1 wherein said sharp projections in said edge zones are adapted to engage said floor covering units from a plurality of directions and wherein said sharp projections are adapted to prevent said floor covering units from moving along or away from a seam created by adjacent floor covering units.

12. A method for joining modular floor coverings, the method comprising:

placing a connector plate on a supporting surface, said connector plate comprising:

a plate having an upper surface and a lower surface, said lower surface being substantially smooth and said upper surface having a perimeter edge and being divided into a flat central zone and a set of edge zones, said set of edge zones extending transversely along said perimeter edge between said perimeter edge and said flat central zone;

a plurality of sharp projections extending upwardly at spaced locations from said set of edge zones, said projections having a top and body portion, the top being tapered to promote piercing engagement with a floor covering backing and the body extending upwards from the upper surface at an angle of less than 90 degrees, and said projections extending inwardly towards said central zone; and positioning a first floor covering unit having a backing on the connector plate such that the backing of the first floor covering unit covers a first portion of the upper surface of the connector plate; and securing the first floor covering unit on the connector plate by applying a pressure on the first floor covering unit such that the backing is penetrated by and engaged with the plurality of sharp upstanding projections of the connector plate.

13. The method of claim 12 wherein said upper surface further comprises a set of score lines and wherein the first floor covering unit is aligned on said connector plate at least in part by said score lines.

14. The method of claim 12 wherein said plate is rectangular.

15. The method of claim 12 further comprising positioning a second floor covering unit having a backing on the connector plate such that the backing of the second floor covering unit covers a second portion of the upper surface of the connector plate; and securing the second floor covering unit on the connector plate by applying a pressure on the second floor covering unit such that the backing is penetrated by and engaged with the plurality of sharp upstanding projections of the connector plate.

16. The method of claim 12 wherein said plate comprises an electro-galvanized plate.

17. The method of claim 12 wherein said connector plate further comprises an adhesive layer positioned on said lower surface, said adhesive layer covered by a releasable backing.

18. The method of claim 17 wherein said releasable backing is a releasable silicon backing adapted to block moisture, and the method further comprising removing the releasable backing prior to placing the connector plate on the supporting surface causing the adhesive layer to adhere to the supporting surface.

19. The method of claim 12 wherein said sharp projections are 5 mm in length from an attached proximal end to said top.

20. The method of claim 12 wherein said edge zones comprise two laterally oriented edge zones and two longitudinally oriented edge zones.

21. The method of claim 12 wherein said sharp projections in said edge zones are adapted to engage said floor covering units on a lateral axis and on a longitudinal axis.

22. The method of claim 12 wherein said sharp projections in said edge zones are adapted to engage said floor covering units from a plurality of directions and wherein said sharp projections are adapted to prevent said floor covering units from moving along or away from a seam created by adjacent floor covering units.

* * * * *